US006971857B2

(12) United States Patent
Nagai

(10) Patent No.: US 6,971,857 B2
(45) Date of Patent: Dec. 6, 2005

(54) FUEL INJECTION PUMP

(75) Inventor: Mitsuru Nagai, Kariya (JP)

(73) Assignee: Denso Corporation, Kariya (JP)

( * ) Notice: Subject to any disclaimer, the term of this patent is extended or adjusted under 35 U.S.C. 154(b) by 347 days.

(21) Appl. No.: 10/448,136

(22) Filed: May 30, 2003

(65) Prior Publication Data

US 2003/0228230 A1 Dec. 11, 2003

(30) Foreign Application Priority Data

Jun. 5, 2002 (JP) ..... 2002-164358

(51) Int. Cl.[7] ..... F04B 23/12; F02M 41/00
(52) U.S. Cl. ..... 417/206; 417/255
(58) Field of Search ..... 417/206, 244, 417/251, 255; 123/447, 510

(56) References Cited

U.S. PATENT DOCUMENTS 5,571,243 A * 11/1996 Arnold et al. ..... 123/198 DB
6,796,778 B2 * 9/2004 Utsumi ..... 417/441

* cited by examiner

*Primary Examiner*—Charles G. Freay
(74) *Attorney, Agent, or Firm*—Nixon & Vanderhye P.C.

(57) ABSTRACT

A fuel injection pump prevents the uninterrupted supply of fuel through an orifice to a cam chamber. An orifice inlet is formed on the same plane as a wall surface of a discharge fuel chamber. As a result, foreign substances, which are carried with the flow of the fuel to the vicinity of the orifice inlet, will fall downward in the discharge fuel chamber to a location away from the orifice inlet thereby preventing the foreign substances from residing in the vicinity of the orifice inlet, as occurs in the case of a conventional fuel injection pump. Specifically, since the foreign substances residing in the vicinity of the orifice inlet can be removed at each engine stop, the amount of foreign substances collected in the vicinity of the orifice inlet can be prevented from increasing during engine operation.

7 Claims, 6 Drawing Sheets

FUEL INJECTION PUMP

CROSS REFERENCE TO RELATED APPLICATION

This application is based upon, claims the benefit of priority of, and incorporates by reference, the contents of Japanese Patent Application No. 2002-164358 filed Jun. 5, 2002.

BACKGROUND OF THE INVENTION

1. Field of the Invention

The present invention relates to a fuel injection pump used on an internal combustion engine.

2. Description of the Related Art

A conventional fuel injection pump includes a housing for pivotably holding a driving shaft, a feed pump formed in the housing, a cam that rotates along with the driving shaft and that is housed within a cam chamber formed in the housing, a plunger placed on the outer circumferential side of the cam, for reciprocating with the rotation of the cam so as to pressurize the fuel drawn into the fuel pressuring chamber, and an orifice formed in the housing for allowing the cam chamber and a discharge fuel chamber of the feed pump to communicate with each other. The feed pump is driven by the driving shaft to draw fuel from the exterior to discharge the fuel into a fuel pressurizing chamber. The fuel is fed from the discharge fuel chamber through the orifice to the cam chamber so that the fuel lubricates a contact portion between the cam and the plunger. Moreover, a diameter of the orifice is appropriately set to minimize the amount of flow of the fuel fed to the cam chamber.

The diameter of the orifice is normally as small as 1 mm or less. If the orifice is large, the process for forming the orifice becomes difficult. Therefore, in order to improve the processability of the orifice, a blind hole (a hole that does not go completely through the workpiece) having a larger diameter than that of the orifice is made first. Next, the orifice is provided at the end of the blind hole so as to penetrate the end of the blind hole.

In a conventional fuel injection pump, the blind hole is made from the side of the discharge fuel chamber at the time of processing the orifice. Specifically, the blind hole is formed on the upstream side of the orifice. During the operation of the fuel injection pump, the fuel passes from the discharge fuel chamber into the blind hole, and then flows through the orifice and into the cam chamber.

With such a structure, if a foreign substance mixed in the fuel flows into the blind hole along with the fuel, the foreign substance concentrates near the bottom of the blind hole and resides in an opening of the orifice on the discharge fuel chamber side, that is, in the vicinity of the orifice inlet. When the amount of the foreign substance residing in the vicinity of the orifice inlet is increased as the length of time that the engine operates increases, there is a possibility that a part of the foreign substance might get stuck on the orifice inlet.

When the engine is stopped to interrupt the flow of the fuel from the discharge fuel chamber to the cam chamber, the foreign substance stuck on the inlet of the orifice falls from the orifice inlet to an inner circumferential wall of the blind hole on its bottom side due to the effect of gravity. However, the foreign substance still resides in the blind hole without being discharged to the discharge fuel chamber. When the operation of the engine is restarted to regenerate the flow of the fuel from the discharge fuel chamber to the cam chamber, the foreign substance that has accumulated on the inner circumferential wall of the blind hole on its bottom side returns to the vicinity of the orifice inlet along with the flow of the fuel.

In this manner, in the conventional fuel injection pump, the foreign substance in the fuel always resides in the vicinity of the orifice inlet, and the amount of the foreign substance residing there increases as operation time continues. Therefore, there is a problem in that a part of the foreign substance gets stuck on the orifice inlet and reduces a cross-sectional area of the orifice. This fails to sufficiently supply the fuel that is necessary for lubrication of the cam chamber.

SUMMARY OF THE INVENTION

The present invention has been devised in view of the above problems and has an object of providing a fuel injection pump capable of preventing the amount of a foreign substance residing on an orifice inlet from increasing with the elapse of operation time so as to prevent the fuel supply to a cam chamber from being impeded.

In order to achieve the above object, the present invention employs the following technical means. A fuel injection pump according to a first aspect of the present invention includes a housing for pivotably holding a driving shaft, a feed pump formed in the housing, the feed pump being driven by the driving shaft to draw fuel from an exterior location to discharge the fuel into a fuel pressurizing chamber. Additionally employed is a cam, for rotating with the driving shaft, housed within a cam chamber formed in the housing, a plunger placed on an outer circumferential side of the cam for reciprocating along with the rotation of the cam to pressurize the fuel drawn into the fuel pressurizing chamber, and an orifice formed through the housing for allowing the cam chamber and a discharge fuel chamber of the feed pump to communicate with each other. The fuel is supplied from the discharge fuel chamber through the orifice to the cam chamber and an opening of the orifice on the discharge fuel chamber side is formed in the same plane as a wall surface of the discharge fuel chamber.

With this structure, a foreign substance, which is carried with the flow of the fuel to the vicinity of the orifice inlet to reside there during operation of the engine, falls to a lower part of the discharge fuel chamber when the engine stops due to the effect of gravity. The area of the wall surface of the discharge fuel chamber is considerably larger than that of the bottom of a blind hole in a conventional fuel injection pump. Therefore, in the fuel injection pump of the present invention, the foreign substance does not reside in the vicinity of the orifice inlet when the engine is stopped, as otherwise occurs in the case of the conventional fuel injection pump. In other words, the foreign substance in the vicinity of the orifice inlet can be removed at each engine stop. Thus, the amount of the foreign substance residing in the orifice inlet can be restrained from increasing with the elapse of engine operation time so as to prevent the obstruction of fuel supply to the cam chamber.

In this case, if the opening of the orifice on the discharge fuel chamber side is formed in a plane projecting from the wall surface of the discharge fuel chamber into the discharge fuel chamber, as in a fuel injection pump according to a second aspect of the present invention, the foreign substance, which is carried to the vicinity of the orifice inlet to reside there, can be made to fall in a downward direction of the discharge fuel chamber due to the effect of gravity when the engine is stopped, as in the case of the fuel injection pump according to the first aspect of the present invention.

Furthermore, the orifice is formed to have its opening not on the wall surface of the discharge fuel chamber where a flow rate of the fuel is small, but on a portion distant from the wall surface where a flow rate of the fuel is large. As a result, during the operation of the engine, the foreign substance, which approaches or gets stuck on the orifice inlet, can be separated from the orifice inlet with the flow of the fuel at a high flow rate. Thus, the amount of the foreign substance residing in the orifice inlet is restrained from being increased with the elapse of operation time, thereby preventing the fuel supply to the cam chamber from being impeded.

A fuel injection pump according to a third aspect of the present invention has such a structure that an orifice is formed in a member distinct from the housing and the member is secured to the housing. As a result, since the orifice is processed into the member that is smaller than the housing, the process for forming the orifice can be easily carried out while enhancing the shape accuracy of the orifice. Moreover, in the case where a diameter of the orifice is required to be changed because of a change in specifications of the fuel injection pump or the like, such a change can be simply realized by making a change in the inexpensive member instead of in the housing.

In a fuel injection pump according to a fourth aspect of the present invention, the member is a cylindrical pin, and the orifice is a through hole provided in an axial direction of the pin. As a result, the orifice can be easily formed with good accuracy.

A fuel injection pump according to a fifth aspect of the present invention includes a housing for pivotably holding a driving shaft, a feed pump formed in the housing, the feed pump being driven by the driving shaft to draw fuel from an exterior location to discharge the fuel into a fuel pressurizing chamber, a cam housed within a cam chamber formed in the housing, for rotating with the driving shaft, a plunger placed on an outer circumferential side of the cam, for reciprocating along with the rotation of the cam to pressurize the fuel drawn into the fuel pressurizing chamber, and an orifice formed through the housing, for allowing the cam chamber and a discharge fuel chamber of the feed pump to be communicated with each other.

Additionally, a fuel injection pump according to a fifth aspect of the present invention includes a slidable member provided in the cam chamber so as to be abuttable on an axial end face of the cam. Also, a positioning pin presses into and secures to the housing so that its tip projects into the cam chamber, while the tip of the positioning pin is fitted into a hole provided in the slidable member. The fuel is supplied from the discharge fuel chamber through the orifice to the cam chamber and the orifice is formed by providing a through hole in an axial direction of the positioning pin. An opening of the orifice on the discharge fuel chamber side is formed on the same plane of a wall surface of the discharge fuel chamber. With this structure, during operation of the engine, a foreign substance, which is carried with the flow of the fuel to the vicinity of the orifice inlet to reside there, falls into the discharge fuel chamber when the engine stops due to the effect of gravity. The area of the wall surface of the discharge fuel chamber is considerably larger than that of the bottom of a blind hole in a conventional fuel injection pump. Therefore, in the fuel injection pump of the present invention, the foreign substance does not reside in the vicinity of the orifice inlet when the engine stops, as otherwise occurs in the case of a conventional fuel injection pump. In other words, the foreign substance in the vicinity of the orifice inlet can be removed each time the engine stops. Thus, the amount of the foreign substance residing in the orifice inlet can be prevented from increasing with the elapse of operation time so as to prevent the fuel supply to the cam chamber from being impeded.

Moreover, one of a plurality of positioning pins pressed into the housing for preventing the rotation of the slidable member as in the conventional fuel injection pump is also used as the orifice. As a result, the orifice can be easily and accurately formed without increasing the number of parts. At the same time, the number of processing steps of the housing can be reduced.

In this case, if the opening of the orifice on the discharge fuel chamber side is formed on a plane projecting from the wall surface of the discharge fuel chamber into the discharge fuel chamber as in a fuel injection pump according to a sixth aspect of the present invention, the foreign substance, which is carried to the vicinity of the orifice inlet to reside there, can be made to fall to a lower part of the discharge fuel chamber due to the effect of gravity during engine stop, as in the case of the above-described fuel injection pump according to the fifth aspect of the present invention. Furthermore, the orifice is formed to have its opening not on the wall surface of the discharge fuel chamber where a flow rate of the fuel is small, but on a portion away from the wall surface where a flow rate of the fuel is large. As a result, during the operation of the engine, the foreign substance, which approaches or gets stuck on the orifice inlet, can be separated from the orifice inlet with a high fuel flow rate. Thus, the amount of the foreign substance residing in the orifice inlet is prevented from increasing with the elapse of operation time, thereby preventing the fuel supply to the cam chamber from being impeded.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. Hereinafter, a fuel injection pump according to the present invention will be described with reference to the accompanying drawings.

(First Embodiment)

Figure 1:
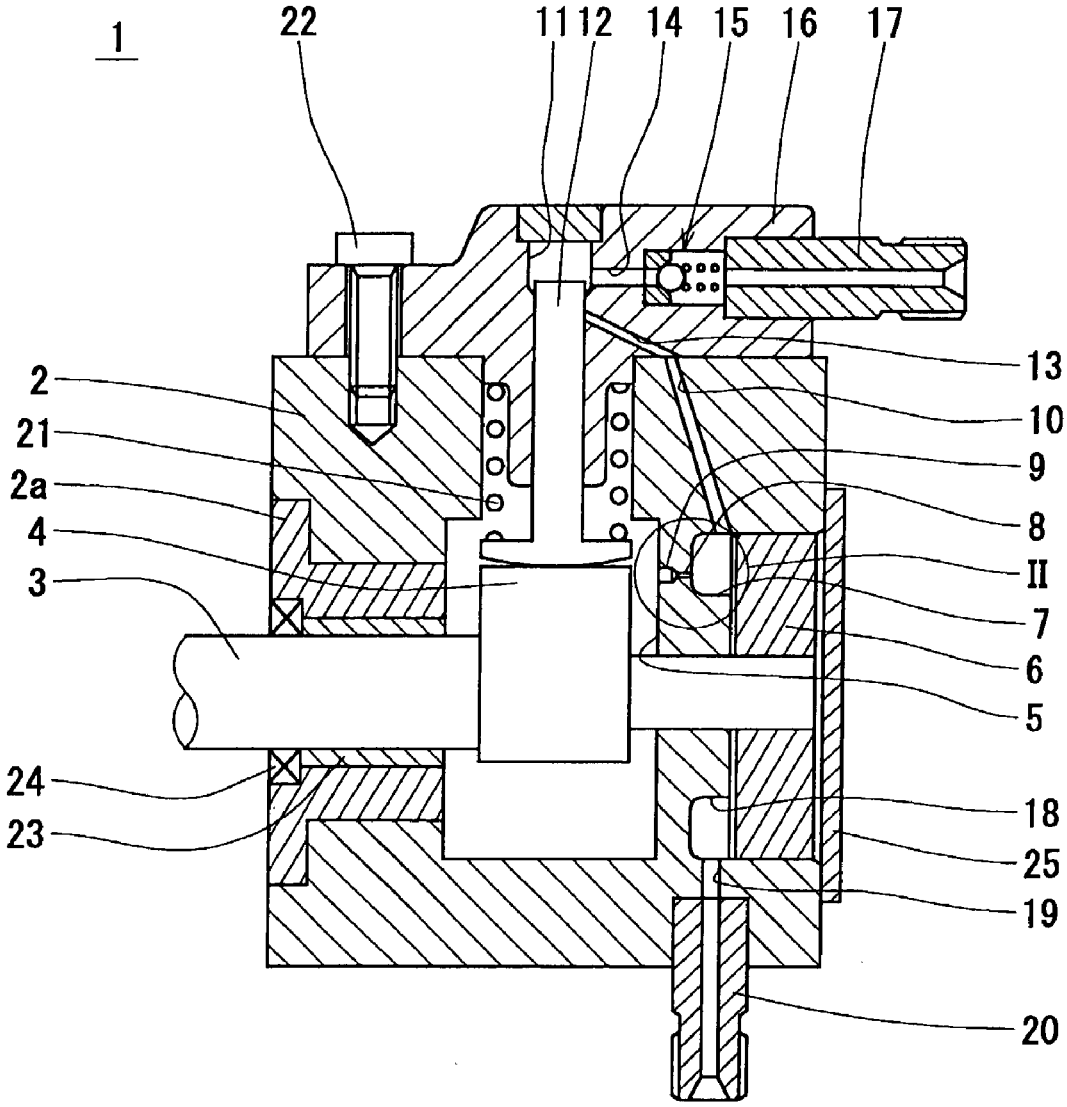
FIG. 1 is a cross-sectional view showing a state where a plunger 12 of a fuel injection pump 1 is at top dead center position according to a first embodiment of the present invention.
Figure 2:
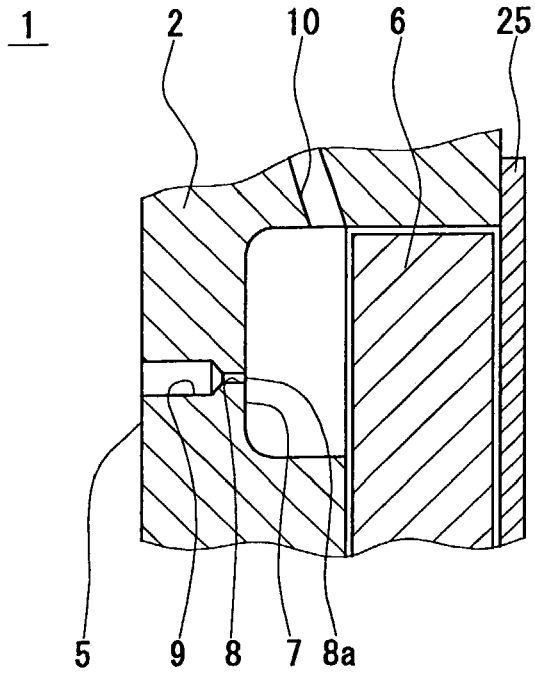
FIG. 2 is a partial, enlarged cross-sectional view of the fuel injection pump 1 corresponding to an enlarged view of portion II in FIG. 1 according to the first embodiment of the present invention.

FIG. 1 is a cross-sectional view of a fuel injection pump 1 according to a first embodiment of the present invention. FIG. 2 is a partial, enlarged view of the fuel injection pump 1 corresponding to an enlarged view of a portion II in FIG. 1 according to the first embodiment of the present invention.

The fuel injection pump 1 is mountable on an engine (not shown) of a vehicle (not shown). The fuel injection pump 1 includes, as shown in FIG. 1, a housing 2 for freely and pivotably holding a driving shaft 3 equipped with a cam 4, a plunger 12 that reciprocates by the rotation of the cam 4, and a cylinder 16 for freely and slidably holding the plunger 12, which is secured to the housing 2 by a bolt 22. Fuel in a fuel tank (not shown) is drawn by a feed pump 6 formed in the housing 2, the feed pump 6 being driven by the driving shaft 3. The drawn fuel passes through a first fuel path 10 provided through the housing 2 and a second fuel path 13 provided through the cylinder 16, to be supplied to the cylinder 16 where the fuel is pressurized by movement of the plunger 12. Then, the fuel is delivered through a fuel discharge path 14 and a discharge connector 17, which are provided for the cylinder 16, to a fuel injection valve (not shown).

The housing 2 is formed of a metal material, for example, aluminum or the like. The housing 2 freely and pivotably holds the driving shaft 3 via a bearing cover 2*a* secured to the housing 2. A bearing 23 and an oil seal 24 are attached onto the bearing cover 2*a*. The bearing 23 freely and pivotably supports the driving shaft 3, and the oil seal 24 maintains a sealed state in the fuel injection pump 1. The driving shaft 3 is synchronously driven by a crankshaft (not shown) of the engine (not shown). The driving shaft 3 is equipped with the cam 4. The cam 4 is housed within the cam chamber 5 formed in the housing 2 so as to pivot in a cooperative manner with the driving shaft 3. On an end of the driving shaft 3 on the side opposite (the right side in FIG. 1) to the engine side (the left side in FIG. 1), a feed pump 6 is attached.

The feed pump 6 is composed of a vane type pump, a trochoid type pump, a gear type pump, or the like. The feed pump 6 is driven by the driving shaft 3 to draw and pressurize fuel from the fuel tank (not shown) through the connector 20, the suction path 19, and the suction fuel chamber 18 to discharge the fuel to the discharge fuel chamber 7. The fuel is in turn delivered from the discharge fuel chamber 7 to the first fuel path 10 provided through the housing 2. The first fuel path 10 is, as shown in FIG. 1, in communication with the second fuel path 13 formed through the cylinder 16 at the joint surface between the housing 2 and the cylinder 16 described below. Moreover, a cover 25 ensures sealing of the feed pump 6.

The cylinder 16, which is made of a metal material, for example, alloy steel or the like, slidably holds the plunger 12. The cylinder 16 is secured to the housing 2 by fastening the bolt 22 thereto. The plunger 12 is made of a metal material, for example, alloy steel or the like. The plunger 12 is energized toward the driving shaft 3 by a plunger spring 21 abutting on an end of the plunger 12 on the driving shaft 3 side so as to always abut on the cam 4. As a result, the plunger 12 reciprocates within the cylinder 16 in response to the rotation of the cam 4. Moreover, a fuel pressurizing chamber 11 is formed by the cylinder 16 and an end of the plunger 12 opposite to the driving shaft 3 side. The discharge path 14 has an opening end on the wall face of the fuel pressurizing chamber 11.

A check valve 15 is placed on the downstream side of the discharge path 14. Further downstream of the discharge path 14, a discharge connector 17 is secured. A high-pressure pipe (not shown) is connected to the discharge connector 17 so as to supply the highly pressurized fuel to a fuel injection valve (not shown).

In the fuel injection pump 1, a contact portion between the cam 4 and the plunger 12 is lubricated with the fuel. As shown in FIG. 1, an orifice 8 for allowing the cam chamber 5 and the discharge fuel chamber 7 to communicate with each other is formed through the housing 2. The fuel for lubrication is supplied from the discharge fuel chamber 7 through the orifice 8 to the cam chamber. An orifice inlet 8*a* corresponding to an opening of the orifice 8 on the discharge fuel chamber 7 side is formed in the same plane as a wall surface of the discharge fuel chamber 7, as shown in FIG. 2. Moreover, a diameter of the orifice 8 is set so that the amount of flow of the fuel supplied from the discharge fuel chamber 7 to the cam chamber 5 is appropriate, that is, necessary and sufficient. An opening of the orifice 8 on the cam chamber 5 side has its opening end on the wall surface of the cam chamber 5, and faces a bottom of a closed-end hole 9 having a diameter larger than that of the orifice 8.

Herein, a process for forming the orifice 8 through the housing 2 will be briefly described. The orifice 8 is formed at a mechanical process step of the housing 2 alone. A diameter of the orifice 8 is normally 1 mm or less. A large number of steps are required to thread such a narrow hole to have a long length. On the other hand, in view of the function of the orifice 8, that is, limiting the amount of flow of the fuel to an appropriate amount, even a short length of the orifice 8 does not present any problem. Therefore, the closed-end hole 9 having a diameter larger than that of the orifice 8 is processed and formed from the cam chamber 5 side (the left side in FIG. 2). Specifically, the closed-end hole 9 is formed as a blind hole so as not to penetrate to reach the discharge fuel chamber 7 side. Next, a narrow hole having a predetermined diameter is processed from the bottom of the closed-end hole 9 so as to reach the discharge fuel chamber 7 side, thereby forming the orifice 8.

In a conventional fuel injection pump, a closed-end hole is processed from the discharge fuel chamber 7 side, followed by the formation of an orifice. Therefore, the closed-end hole is formed on the upstream side of the orifice (on the discharge fuel chamber 7 side). Specifically, during the operation of the engine, the fuel for lubricating the cam chamber 5 first flows from the discharge fuel chamber 7 into the closed-end hole 9 and then passes through the orifice 8 to be supplied to the cam chamber 5. In this configuration, if a foreign substance mixed in the fuel flows into the closed-end hole along with the flow of the fuel, the foreign substance concentrates in the vicinity of the bottom of the closed-end hole, residing in the vicinity of the orifice inlet. The amount of the foreign substance residing in the vicinity of the orifice inlet increases along with the elapse of operation time of the engine. Accordingly, there is a possibility that a part of the foreign substance might get stuck on the inlet of the orifice. On the other hand, when the engine stops to interrupt the flow of the fuel from the discharge fuel chamber 7 into the cam chamber 5, the foreign substance stuck on the orifice inlet detaches from the orifice inlet and falls onto the inner circumferential wall of the closed-end hole on its bottom side due to the effect of gravity. However, the foreign substance still resides in the closed-end hole without being discharged from the closed-end hole to the discharge fuel chamber 7. When the operation of the engine is restarted to cause the flow of the fuel from the discharge fuel chamber to the cam chamber, the foreign substance accumulating on the inner circumferential bottom side wall of the closed-end hole returns to the vicinity of the orifice inlet along with the flow of the fuel.

In this manner, in the conventional fuel injection pump, the foreign substance in the fuel always resides in the vicinity of the inlet. In addition, the amount of the foreign substance residing there increases with the elapse of operation time. Therefore, a part of the foreign substance gets stuck on the orifice inlet to decrease a cross-sectional area of the orifice. As a result, a sufficient amount of the fuel that is required for lubrication cannot be provided to the cam chamber.

In the above-described fuel injection pump according to the first embodiment of the present invention, the orifice inlet 8*a* corresponding to the opening of the orifice 8 on the discharge fuel chamber 7 side is formed on the same plane as the wall surface of the discharge fuel chamber 7. Therefore, the foreign substance, which is carried with the flow of the fuel and adheres onto and resides on the wall surface of the discharge fuel chamber 7 in the vicinity of the orifice inlet 8*a* during operation of the engine, falls into the discharge fuel chamber in a downward direction due to the effect of gravity when the engine is stopped. The area of the wall surface of the discharge fuel chamber 7 is considerably larger than a cross-sectional area of the closed-end hole in the conventional fuel injection pump. Therefore, in the fuel injection pump 1 of the present invention, the foreign substance adhered onto and residing on the wall surface of the discharge fuel chamber 7 in the vicinity of the orifice inlet 8*a* during engine stop is present at a considerably far position compared with the conventional fuel injection pump. Therefore, even when the engine is restarted, the foreign substance that has fallen down does not move toward the orifice inlet 8*a*. In other words, at each stop of the engine, the foreign substance residing in the vicinity of the orifice inlet 8*a* can be removed. Thus, the amount of the foreign substance residing in the orifice inlet 8*a* is prevented from increasing with the elapse of operation time so as to prevent the fuel supply to the cam chamber 5 from being impeded.

(Second Embodiment)

Figure 3:
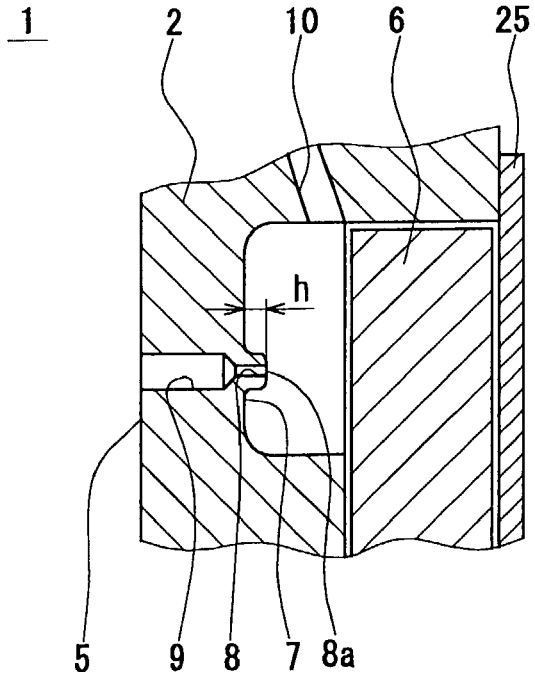
FIG. 3 is a partial, enlarged cross-sectional view of the fuel injection pump 1 according to a second embodiment of the present invention.

Next, the fuel injection pump 1 according to a second embodiment of the present invention will be described. FIG. 3 is a partial, enlarged cross-sectional view of the fuel injection pump 1 according to the second embodiment of the present invention.

In the fuel injection pump 1 according to the second embodiment of the present invention, as shown in FIG. 3, the orifice inlet 8*a*, corresponding to the opening of the orifice 8 on the discharge fuel chamber 7 side, is formed in a plane that projects toward the inside of the discharge fuel chamber 7 by a length h. During the operation of the engine, a flow rate of the fuel within the discharge fuel chamber 7 is small on the wall surface. The farther the distance from the wall surface, the higher the flow rate of the fuel. That is, the fuel flow rate increases with the distance away from the wall. At the same time, a variation in flow rate is also increased. Thus, in the fuel injection pump 1 according to the second embodiment of the present invention, the same effects as those of the fuel injection pump according to the first embodiment of the present invention described above can be obtained.

Specifically, at each stop of the engine, the foreign substance residing in the vicinity of the orifice inlet 8*a* can be removed. At the same time, during operation of the engine, the foreign substance approaching the orifice inlet 8*a* or getting stuck on the orifice inlet 8*a* can be separated from the orifice inlet 8*a* with a higher fuel flow rate. Thus, the amount of the foreign substance residing in the orifice inlet 8*a* is prevented from increasing with the elapse of operation time so as to prevent the fuel supply to the cam chamber 5 from being impeded.

(Third Embodiment)

Figure 4:
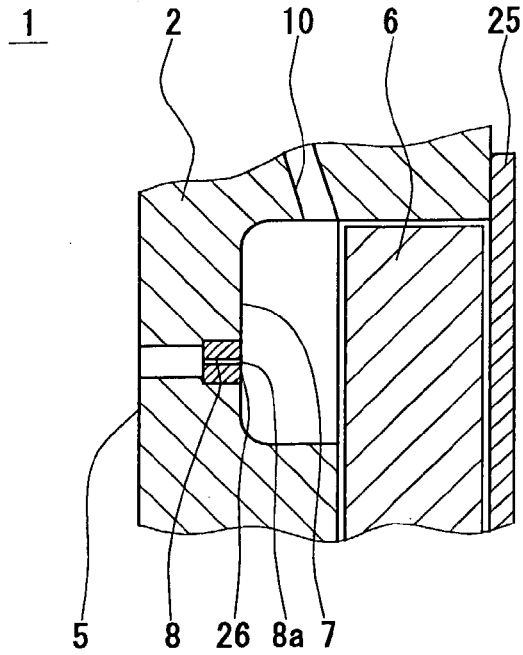
FIG. 4 is a partial, enlarged cross-sectional view of the fuel injection pump 1 according to a third embodiment of the present invention.

Next, the fuel injection pump 1 according to a third embodiment of the present invention will be described. FIG. 4 is a partial, enlarged cross-sectional view of the fuel injection pump 1 according to the third embodiment of the present invention.

In the fuel injection pump 1 according to the third embodiment of the present invention, the orifice 8 is formed by providing a through hole in an axial direction through an orifice pin 26 that is a distinct, separate member from the housing 2 and has the shape of a cylindrical pin. The orifice pin 26 is pressed and secured into the housing 2 so that the orifice inlet 8*a* is flush with the wall surface of the discharge fuel chamber 7. As a result, the orifice 8 can be formed by a simple step of processing the through hole through the orifice pin 26 which is a considerably smaller part than the housing 2. At the same time, the shape accuracy of the orifice 8 can be enhanced. Moreover, if a flow rate of the fuel supplied to the cam chamber 5 is changed along with a change in specifications of the fuel injection pump 1, it is necessary to alter the diameter of the orifice 8. In this case, in the fuel injection pump 1 according to the third embodiment of the present invention, such a change can be realized by simple and inexpensive means of changing the diameter of the through hole formed in the orifice pin 26 without increasing the number of types of the housing 2.

(Fourth Embodiment)

Figure 5:
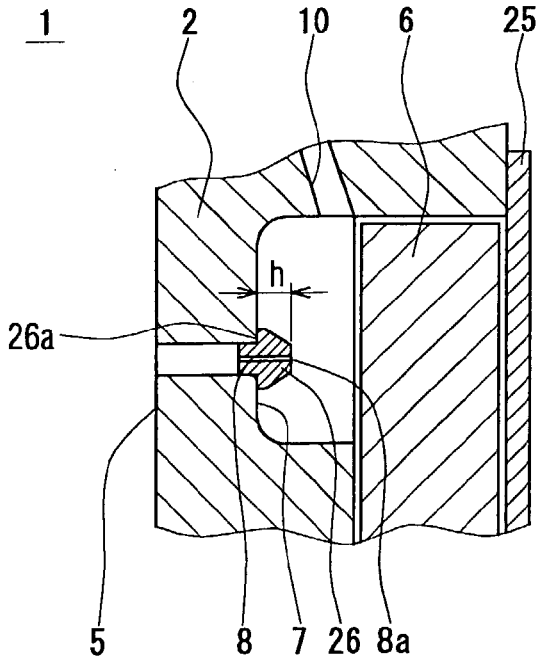
FIG. 5 is a partial, enlarged cross-sectional view of the fuel injection pump 1 according to a fourth embodiment of the present invention.

Next, the fuel injection pump 1 according to a fourth embodiment of the present invention will be described. FIG. 5 is a partial enlarged cross-sectional view of the fuel injection pump 1 according to the fourth embodiment of the present invention.

In the fuel injection pump 1 according to the fourth embodiment of the present invention, the shape of the orifice pin 26 in the third embodiment is altered. Specifically, a step portion 26*a* is provided at a position away from the orifice inlet 8*a* of the orifice pin 26 by the length h so that the orifice pin 26 projects toward the inside of the discharge fuel chamber 7. In this manner, the orifice inlet 8*a* is formed on the plane projecting from the wall surface of the discharge fuel chamber 7 into the discharge fuel chamber 7 by the length h. As a result, the same effects as those of the fuel injection pump 1 of the second and the third embodiments of the present invention can be obtained. Moreover, when the orifice pin 26 is pressed into the housing 2, the step portion 26*a* is made to abut on the wall surface of the discharge fuel chamber 7, whereby the projecting length h of the orifice pin 26 into the discharge fuel chamber 7 can be easily and precisely set.

(Fifth Embodiment)

Figure 6:
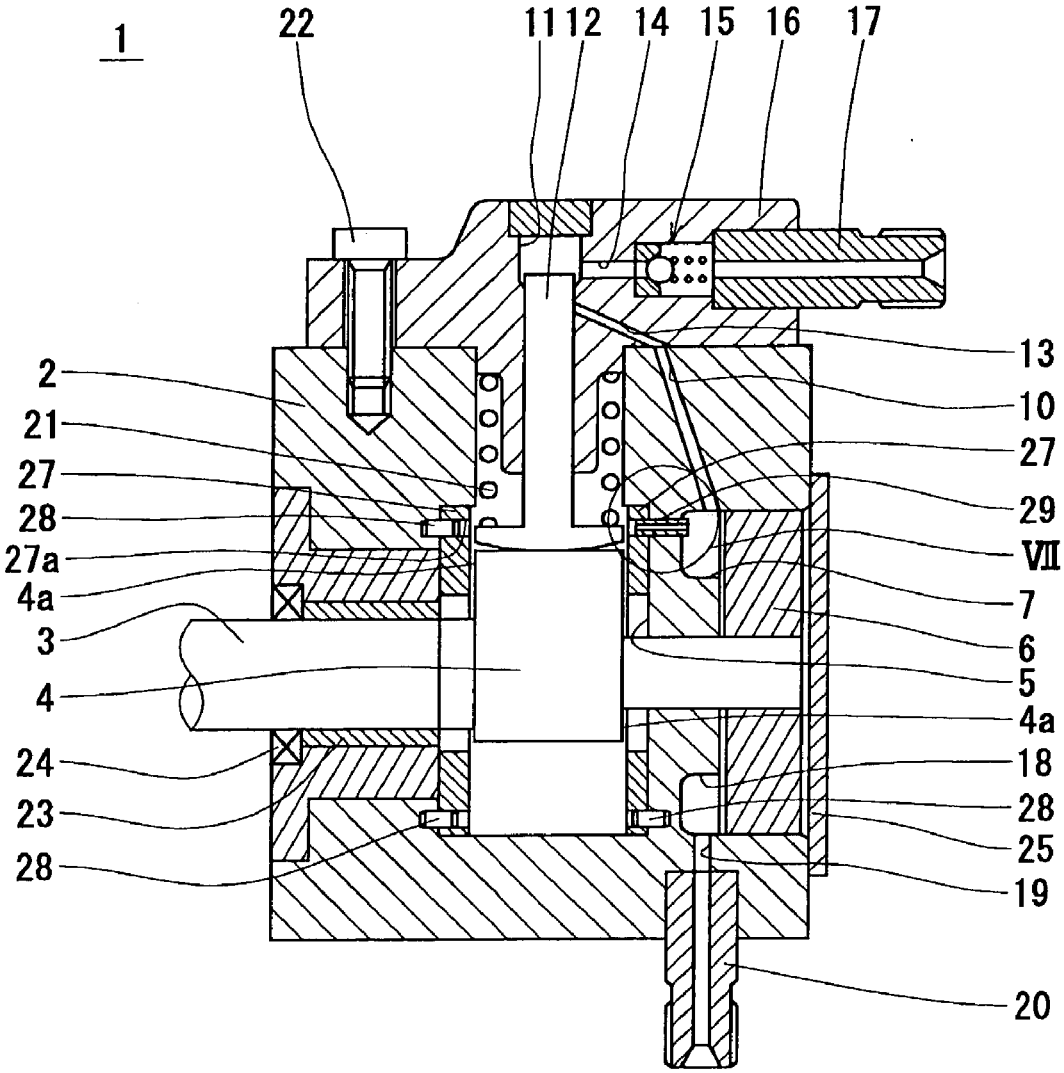
FIG. 6 is a cross-sectional view of the fuel injection pump 1 according to a fifth embodiment of the present invention.
Figure 7:
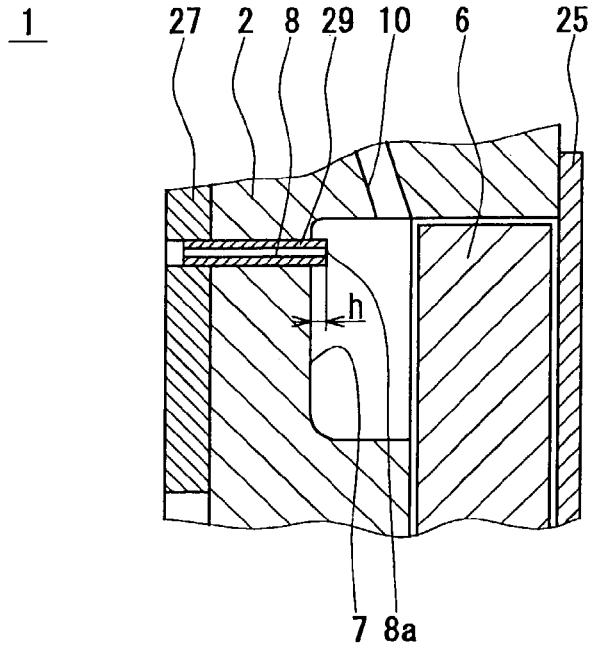
FIG. 7 is a partial, enlarged cross-sectional view of the fuel injection pump, 1 corresponding to portion VII in FIG. 6 according to the fifth embodiment of the present invention.

Next, the fuel injection pump 1 according to a fifth embodiment of the present invention will be described. FIG. 6 is a cross-sectional view of the fuel injection pump 1 according to the fifth embodiment of the present invention. FIG. 7 is an enlarged view of portion VII in FIG. 6.

In the fuel injection pump 1 according to the fifth embodiment of the present invention, as shown in FIG. 6, the housing 2 includes a thrust washer 27 in the cam chamber 5, which is a slidable member abuttably placed on an axial end face 4*a* of the cam 4. The thrust washer 27, which is made of a material having excellent abrasive resistance, has a pair of through holes 27*a* provided in an axial direction of the driving shaft 3. A pin 28 serving as a positioning pin which is pressed into and secured to the housing 2 is fitted into each of the through holes 27*a*, thereby preventing the thrust washer 27 from pivoting with the cam 4. One of the two pins 28 for positioning the thrust washer 27 on the fuel discharge chamber 7 side (the right side in FIG. 7) is used as an orifice pin 29 having the orifice 8 formed by making the through hole in the axial direction, as shown in FIG. 7. At the same time, the holes for the pins 28, formed in the housing 2, are brought into communication with the discharge fuel chamber 7. Furthermore, the orifice pin 29 is formed to project from the wall surface of the discharge fuel chamber 7 toward the inside of the discharge fuel chamber 7 by the length h so as to be pressed into and secured to the housing 2.

Specifically, the orifice inlet 8*a* has its open end at the position projecting from the wall surface of the discharge fuel chamber 7 into the inside of the discharge fuel chamber 7. As a result, the same effects as those of the fuel injection pump 1 according to the fourth embodiment can be obtained. In addition, one of a plurality of the pins 28 for preventing the thrust washer 27 from pivoting also serves as the orifice 8 instead of using the orifice pin 29, so that the orifice 8 can be formed with good accuracy without increasing the number of parts. At the same time, the number of processing steps of the housing 2 can be reduced.

(Sixth Embodiment)

Figure 8:
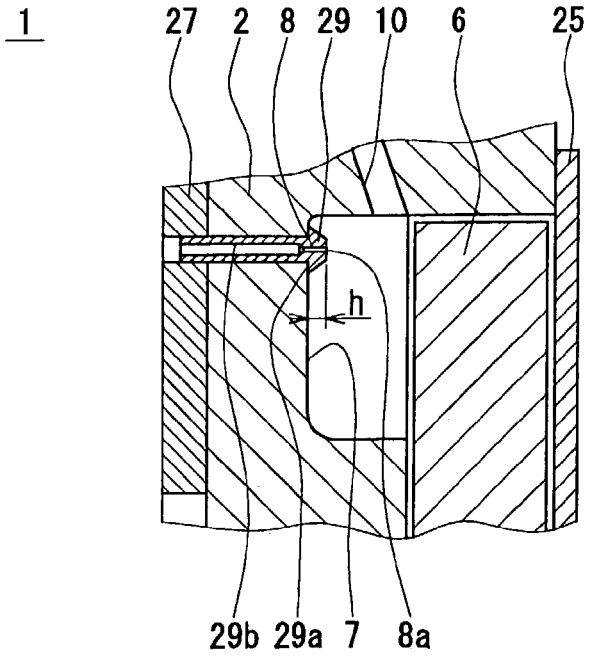
FIG. 8 is a partial, enlarged cross-sectional view of the fuel injection pump 1 according to a sixth embodiment of the present invention.

Next, the fuel injection pump 1 according to a sixth embodiment of the present invention will be described. FIG. 8 is a partial, enlarged cross-sectional view of the fuel injection pump 1 according to the sixth embodiment of the present invention.

In the fuel injection pump 1 according to the sixth embodiment of the present invention, the shape of the orifice pin 29 in the fifth embodiment is changed. Specifically, a step portion 29*a* is provided at a position away from the orifice inlet 8*a* of the orifice pin 29 by the length h. At the same time, a closed-end hole 29*b* is provided. As a result, the same effects as those of the fuel injection pump 1 of the fifth embodiment of the present invention can be obtained. Moreover, when the orifice pin 29 is pressed into the housing 2, the step portion 29*a* is made to abut on the wall surface of the discharge fuel chamber 7, whereby the projecting length h of the orifice pin 29 into the discharge fuel chamber 7 can be easily and precisely set. Moreover, if the closed-end hole 29*b* is processed in advance through the orifice pin 29 at the time of processing the orifice 8, the processed length of the orifice 8 can be minimized which will reduce the number of processing steps.

In the fuel injection pump 1 according to the above-described first to the sixth embodiments of the present invention, a single set of the plunger 12 and the cylinder 16 is provided. However, a plurality of sets of the plunger 12 and the cylinder 16 may be provided in a circumferential direction of the cam 4.

(Seventh Embodiment)

Figure 9:
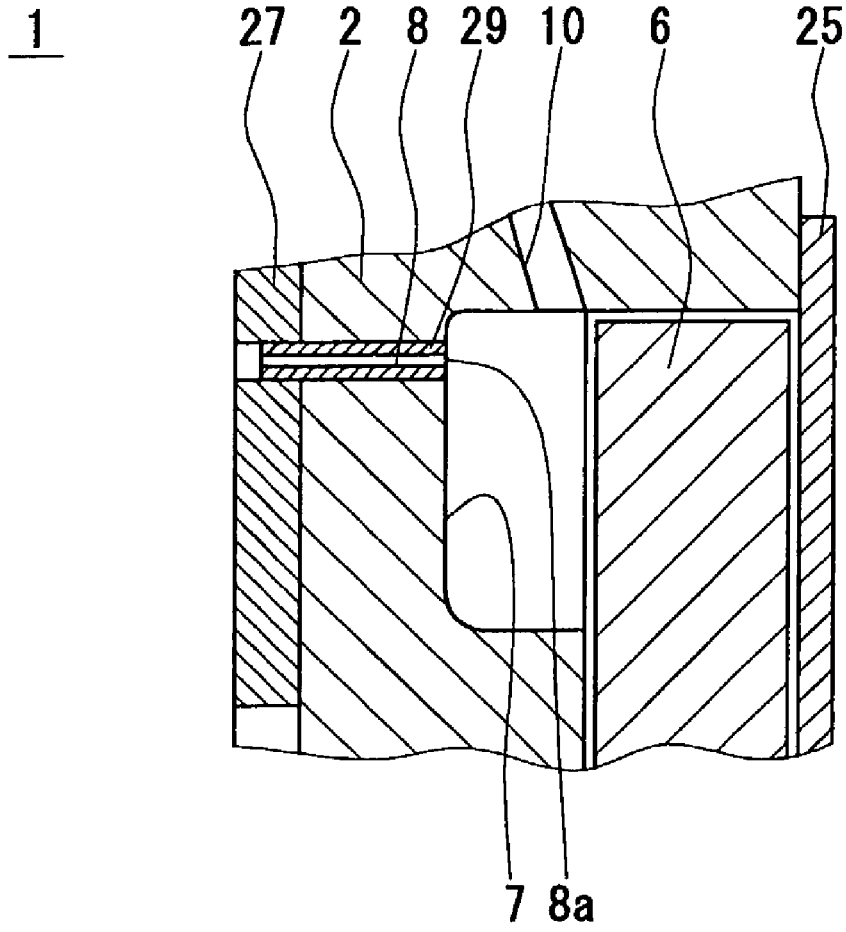
FIG. 9 is a partial, enlarged cross-sectional view of the fuel injection pump 1 of the portion II in FIG. 1 with a modified fuel chamber wall according to a seventh embodiment of the present invention.

FIG. 9 is a partial, enlarged cross-sectional view of the fuel injection pump 1 of the portion II in FIG. 1 with a modified fuel chamber wall 1 according to a seventh embodiment of the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel injection pump comprising:

a housing defining a cam chamber and an orifice;

a driving shaft rotating within the housing;

a feed pump formed in the housing, wherein the feed pump is driven by the driving shaft to draw fuel and discharge the fuel into a fuel pressurizing chamber;

a cam housed within the cam chamber, the cam rotating with the driving shaft; and a plunger, wherein the plunger contacts and follows an outer circumferential surface of the cam and reciprocates to pressurize the fuel drawn into the fuel pressurizing chamber, wherein the orifice allows the cam chamber and a discharge fuel chamber of the feed pump to communicate with each other, wherein the fuel is supplied from the discharge fuel chamber through the orifice to the cam chamber, and wherein an opening of the orifice on the discharge fuel chamber side is formed on the same plane as a wall surface of the discharge fuel chamber.

2. A fuel injection pump comprising:

a housing for holding and permitting rotation of a driving shaft, wherein the housing defines an orifice and a cam chamber;

a feed pump formed in the housing, wherein the feed pump is driven by the driving shaft to draw fuel from an exterior location to discharge the fuel into a fuel pressurizing chamber;

a cam housed within the cam chamber formed in the housing, wherein the cam rotates with the driving shaft; and a plunger contacting an outer circumferential area of the cam, wherein the plunger reciprocates with the rotation of the cam to pressurize the fuel drawn into the fuel pressurizing chamber, wherein the orifice formed through the housing allows the cam chamber and a discharge fuel chamber of the feed pump to communicate with each other, wherein the fuel is supplied from the discharge fuel chamber through the orifice to the-cam chamber, and wherein an orifice opening of the orifice on the discharge fuel chamber side is formed on a plane projecting from a wall surface of the discharge fuel chamber into the discharge fuel chamber.

3. The fuel injection pump according to claim 2, wherein the orifice is formed through a part distinct from the housing, and the part is secured to the housing.

4. The fuel injection pump according to claim 3, wherein the part is a cylindrical pin, and the orifice is a through hole provided in an axial direction of the pin.

5. A fuel injection pump comprising:

a housing for rotatably holding a driving shaft, wherein the housing defines an orifice;

a feed pump formed in the housing, the feed pump being driven by the driving shaft to draw fuel from an exterior location to discharge the fuel into a fuel pressurizing chamber;

a cam housed within a cam chamber formed in the housing, for rotating with the driving shaft;

a plunger contacting an outer circumferential surface of the cam for reciprocating with cam rotation to pressurize the fuel drawn into the fuel pressurizing chamber, the housing orifice permitting fluid communication between the cam chamber and a discharge fuel chamber of the feed pump;

a slidable member provided in the cam chamber so as to be abuttable on an axial end face of the cam; and a positioning pin that is pressed into and secured to the housing so that its tip projects into the cam chamber, wherein the tip of the positioning pin is fitted into a hole provided in the slidable member, and the fuel is supplied from the discharge fuel chamber through the orifice to the cam chamber;

wherein the orifice is formed by providing a through hole in an axial direction in the positioning pin, and wherein an opening of the orifice on the discharge fuel chamber side is formed on the same plane of a wall surface of the discharge fuel chamber.

6. A fuel injection pump comprising:

a housing for rotatably holding a driving shaft;

a feed pump formed in the housing, the feed pump being driven by the driving shaft to draw fuel and then discharge the fuel into a fuel pressurizing chamber;

a cam housed within a cam chamber formed in the housing, for rotating with the driving shaft;

a plunger placed on an outer circumferential side of the cam, for reciprocating along with the rotation of the cam to pressurize the fuel drawn into the fuel pressurizing chamber, an orifice being formed through the housing, for allowing the cam chamber and a discharge fuel chamber of the feed pump to communicate with each other;

a slidable member provided in the cam chamber so as to be abuttable on an axial end face of the cam; and a positioning pin pressed into and secured to the housing so that its tip projects into the cam chamber, wherein the tip of the positioning pin is fitted into a hole provided in the slidable member, and the fuel is supplied from the discharge fuel chamber through the orifice to the cam chamber, wherein the orifice is formed by providing a through hole in an axial direction in the positioning pin, and wherein an opening of the orifice on the discharge fuel chamber side is formed so as to project from a wall surface of the discharge fuel chamber.

7. The fuel injection pump according to claim 5, wherein the opening of the orifice on the discharge fuel chamber side is formed on a plane projecting from the wall surface of the discharge fuel chamber into the discharge fuel chamber.

* * * * *